United States Patent [19]

Levis

[11] 4,359,351

[45] Nov. 16, 1982

[54] PROTECTIVE ATMOSPHERE PROCESS FOR ANNEALING AND OR SPHEROIDIZING FERROUS METALS

[75] Inventor: Robert W. Levis, Breinigsville, Pa.

[73] Assignee: Air Products and Chemicals, Inc., Allentown, Pa.

[21] Appl. No.: 87,360

[22] Filed: Oct. 23, 1979

[51] Int. Cl.[3] ..... C21D 1/48

[52] U.S. Cl. ..... 148/16.7; 148/139

[58] Field of Search ..... 148/16.5, 16.6, 16.7, 148/20.3, 139, 16.0

[56] References Cited

U.S. PATENT DOCUMENTS

| | | | |
|---|---|---|---|
| 2,673,821 | 3/1954 | Stutzman | 148/16.5 |
| 2,875,113 | 2/1959 | Fitz | 148/16.7 |
| 4,049,472 | 9/1977 | Arndt | 148/16 |
| 4,139,375 | 2/1979 | Solomon et al. | 148/16.7 |
| 4,154,629 | 5/1979 | Asai et al. | 148/16.6 |

FOREIGN PATENT DOCUMENTS

| | | |
|---|---|---|
| 748320 | 4/1956 | United Kingdom . |
| 804864 | 11/1958 | United Kingdom . |
| 911479 | 11/1962 | United Kingdom . |

*Primary Examiner*—John P. Sheehan

*Attorney, Agent, or Firm*—James C. Simmons; E. Eugene Innis

[57] ABSTRACT

Methanol and nitrogen are injected into a furnace utilized for annealing or spheroidizing metal articles. The methanol reacts inside the furnace to provide an atmosphere with a carbon potential that will minimize or prevent carbon removal or carbon addition to the surface of the ferrous metals being treated.

8 Claims, No Drawings

PROTECTIVE ATMOSPHERE PROCESS FOR ANNEALING AND OR SPHEROIDIZING FERROUS METALS

BACKGROUND OF THE INVENTION

1. Field of the Invention

The invention pertains to the field of thermal metallurgical treating, and in particular to the annealing or spheroidizing of ferrous metals under controlled atmospheres. Ferrous metals are defined as the conventional grades of steel being denoted by grade according to the American Iron and Steel Institute (AISI) nomenclature which contain carbon and in particular to the steels conventionally designated as plain carbon, alloy steels, and alloy tool steels. As these grades of steel are raised to elevated temperature for annealing and/or spheroidizing under an ambient furnace atmosphere containing air, hydrogen, water vapor, carbon dioxide, and other chemical compounds it is well known that the surface of the steel will become reactive. Furthermore, in the presence of water vapor, hydrogen and carbon dioxide in the furnace atmosphere carbon at the surface of the steel will react and be removed from the surface. Removal of carbon from the surface promotes inhomogeniety of the cross section due to the change in chemistry and crystallography, thus changing the physical properties such as surface hardness and strength of articles which are subsequently fabricated from the ferrous metal. In the normal course the area of the metal that has been depleted of carbon must be removed by expensive finishing operations such as machining, grinding, pickling and the like.

In order to condition the plain carbon, alloy steel and alloy tool steel articles for subsequent fabricating operations it is often necessary to anneal or spheroidize the metal so that it is in its softest condition for subsequent machining, cold forging, bending, or other room temperature fabrication operations. Annealing usually encompasses heating the metal above its transition temperature so that the crystalline structure (micro structure) is that of austenite (a solid solution in which gamma iron is the solvent characterized by a face-centered cubic crystal structure), and thereafter slowly cooling the metal so that as the temperature drops below the transformation temperature a micro structure consisting of ferrite (solid solution in which alpha iron is the solvent and which is characterized by a body-centered cubic crystal structure) and carbide (a compound of carbon and iron) is formed. Very often a micro structure known as pearlite, which is a lamellar aggregate of ferrite and carbide is achieved. As the carbon content increases and sometimes the alloy content, with or without an increase in carbon content, it becomes necessary to perform a treatment called spheroidizing wherein the carbide is converted to a round or globular form to promote maximum machineability and cold working properties. Spheroidizing can take place by heating the metal to a temperature above the transformation temperature followed by a prolonged slow cooling to cause precipitation and agglomeration of the carbides, or by prolonged heating at a temperature below the transformation temperature followed by a slow cooling or oscillations of heating temperature above and below the transformation temperature for the particular ferrous metal being treated, or by austenitizing, cooling to below the transformation temperature and holding followed by slow cooling.

2. Description of the Prior Art

The prior art in regard to thermal treatment of ferrous metals under carbon controlled atmospheres is adequately summarized in the specification of U.S. Pat. No. 4,049,472, which is incorporated herein by reference.

According to the prior art, protective atmospheres for annealing and or spheroidizing can be generated by reaction of air and natural gas or other fuel gases. In order to anneal the low carbon steels (less than 0.1% carbon) a lean exothermic atmosphere formed by the combustion of the gas-air mixture is used. Water vapor can be removed from the generated atmosphere to lower the decarburizing potential of the atmosphere. Conventionally high carbon steels are annealed or spheroidized in an endothermic atmosphere generated by partially reacting a mixture of fuel gas and air in an externally-heated catalyst-filled reactor. The endothermic atmosphere may contain larger quantities of carbon monoxide and unreactive fuel which serve as carbon sources to prevent loss of carbon from the surface of the ferrous metal. It has been known that for continuous annealing and/or spheroidizing furnaces better control is achieved by mixing exothermic and endothermic gases in varying ratios to adjust the carbon potential of the furnace atmosphere to prevent or minimize decarburization of the surface of the ferrous article being annealed or spheroidized.

SUMMARY OF THE INVENTION

The present invention is drawn to a method for using a gaseous nitrogen and methanol which are injected into a metallurgical furnace maintained at a temperature that will provide a metallurgical anneal and/or spheroidizing treatment on a ferrous metal while the metal is maintained under a protective atmosphere. In its broadest aspect, the invention comprises injecting gaseous nitrogen and from 0.1 to 10 mole percent methanol into the heat treating furnace at the appropriate times and at the appropriate locations as will hereinafter be more fully explained.

In most of the prior art processes that find wide commercial acceptance, the atmospheres are generated externally of the furnace by use of an atmosphere generator wherein air and fuel gas are combusted to form an atmosphere or carrier gas which is then injected into the heat treating furnace. Most of the exothermic and endothermic atmospheres require auxiliary generators thus requiringg a substantial capital expenditure for such equipment. One of the advantages to the present invention is the simple injection of the components into the furnace for reaction to achieve the desired process thus eliminating the need for an auxiliary generator.

DETAILED DESCRIPTION OF THE INVENTION

Annealing is classically defined as a process wherein a metal is heated to and held at a suitable temperature followed by cooling at a suitable rate for a miriad of purposes which can include reducing hardness, improving machineability, facilitating cold working, producing a desired micro structure, or obtaining desired mechanical, physical or other properties. The foregoing is set out in Volume 1 of the Metals Handbook, published in 1964 by the American Society for Metals, Metals Park, Novelty, Ohio. The particular volume of the Metals Handbook is referred to as Properties and Selection of Metals. The definitions of annealing, spheroidizing, transformation temperature, transition point, and transition temperature set out in the Metal Handbook are incorporated herein by reference.

In its most basic sense, annealing is a process whereby the steel is heated above its transition temperature and held for a period of time so that all of the contained carbon is dissolved in the austenitic phase present at that temperature. Subsequent to the solution treating of the ferrous metal, the metal is either cooled to a temperature below the transition temperature and held at temperature for a time or slowly cooled in the furnace or through the use of insulating means, to room temperature so that the austenite transforms to ferrite and an iron carbide known as cementite. Cementite is characterized by an orthorhombic crystalline structure having an approximate chemical formula of $Fe_3C$. The chemical composition of cementite will be altered by the presence of alloying elements such as manganese and other carbide forming elements in the steel composition.

In its broadest sense, spheroidizing consists of heating the ferrous metal to a temperature just below the transition temperature so that the cementite (iron carbide) is converted to a globular form rather than the platelike form which normally occurs after a conventional annealing treatment. Spheroidizing can be accomplished by several processes, use of which is illustrated by a treatment which starts out by heating the metal above the transition temperature and during a prolonged heating cycle, cycling the metal through temperature ranges from above to just below the transition temperature. Alternatively, the metal can be heated to above the transition temperature, cooled to a temperature below the transition temperature and held for a period of time sufficient to promote globular carbide formation. It is also possible to start out by annealing the ferrous metal followed by a thermal treatment below the transition temperature or alternately between temperatures just above and just below the transition temperature.

Normally, both annealing and spheroidizing are carried out in protective atmospheres which serve a number of functions. Basically, the atmosphere protects the steel from oxygen or other oxidizing materials which might cause scaling of the surface and consequently, metal loss. In order to prevent oxidation, the atmosphere is made to contain a reducing component. Normal annealing atmospheres must also prevent loss of carbon from the surface of the metal through the process of decarburization. One method of achieving this protection is to minimize the presence of substances in the furnace atmosphere that will remove carbon by reaction with the surface of the metal. Conventionally, a source of carbon is normally provided in the atmosphere to achieve this purpose. The amount of the source of carbon must be controlled to prevent carburization (gain of carbon) by the surface of the steel which would also promote inhomogeneity of the surface and alter the properties of the metal. Thus, in practice it is necessary to balance the atmosphere between one that is carburizing and one that is decarburizing so that little or no carbon is gained or lost at the surface of the metal.

As set out above traditional protective atmospheres can be either exothermic, endothermic or a mixture of exothermic and endothermic gases.

According to the invention, atmospheres suitable for annealing and/or spheroidizing both low carbon and high carbon steels as well as alloy tool steels can be conveniently and inexpensively generated by introducing into the heat treating furnace a mixture consisting primarily of nitrogen and containing of 0.1 to 10 mole percent methanol. Alternatively, the nitrogen and methanol can be separately and simultaneously injected into the furnace, the former in a gaseous state the latter as a vapor or liquid. The gaseous mixture decomposes to produce hydrogen and carbon monoxide. The hydrogen serves as a reducing agent to prevent surface oxidation and also scavenges any air which might leak into the furnace, while the carbon monoxide serves as a source of carbon to prevent carbon depletion from the metal surface. The precise methanol to nitrogen mixture supplied to the furnace will vary with the temperature of operation, composition of the ferrous metal being treated, configuration of the furnace, the tightness of the furnace (amount of air leaking into the furnace) furnace loading and the like. It has been discovered that a preferred broad range of compositions are as set out above. Within the broad range a mixture containing from about 0.5 to about 3 mole percent by volume methanol, balance nitrogen, affords an atmosphere suitable for annealing and/or spheroidizing most ferrous metals. Increasing the methanol concentration leads to an increase in carbon potential of the furnace atmosphere, conversely, a decrease in methanol results in decreasing the carbon potential of the atmosphere. Thus, to control the atmosphere, one only need to increase the amount of methanol in the composition to prevent carbon loss and to decrease the amount of methanol if carburization is observed.

It is also possible to use the atmosphere generated by the injection of the nitrogen-methanol composition to restore carbon to the surface of a ferrous metal which has previously been hot worked. For this purpose an annealing temperature above the transition temperature is employed with an atmosphere derived from a composition consisting essentially of 0.5 to 10 mole percent methanol, balance nitrogen. The particular temperature and composition employed depends upon the degree of carbon depletion which must be overcome and the other parameters for annealing set out above.

The invention can be illustrated by the following examples:

EXAMPLE 1

Low carbon steel wire (AISI grades 1006, 1008, 1010 and 1015) were spheroidized in a continuous pusher tray furnace. The wire was loaded into trays which were then introduced into the entrance vestibule of the furnace which was purged with pure nitrogen. The trays then passed through a series of eight separate heat treating zones, each one of which was provided with a circulating fan, an individually controlled set of radiant tube heaters and an individual supply of atmosphere gas (methanol-nitrogen). The heat treating zones were followed by a cooling zone which was purged with nitrogen and provided with circulating fans. The trays finally exited through an exit vestibule which was also purged with nitrogen. For this example the elapsed time from introduction of a single tray into the entrance vestibule to its emergence from the exit vestibule was 17 hours. Temperature in zone 1 was maintained at 1,380° F. (749° C.) while the temperature in zones 2 through 7 inclusive was maintained at 1,285° F. (696° C.) and the temperature in zone 8 was 1,150° F. (621° C.). Nitrogen containing 0.75 mole percent methanol was introduced into zones 2 through 7. The furnace was operated continuously and a steady state of temperatures and gas concentrations were attained as shown in Table 1, below.

TABLE I

| FURNACE ATMOSPHERE ANALYSIS | | | | |
|---|---|---|---|---|
| | | | Dew Pt °F. | |
| Time | % CO | % CO2 | Zone 2 | Zone 7 |
| 11:15 a.m. | 0.80 | 0.05 | −35° | −39° |
| 1:10 p.m. | 0.75 | 0.04 | −34° | −40° |
| 4:14 p.m. | 0.75 | 0.04 | −33° | −40° |

The wire exiting the furnace had a shiny surface with a slight soot layer which was easily removed. Subsequent metallurgical examination of samples of the wire indicated a small degree of recarburization. The furnace atmosphere was adjusted to reduce the methanol to a level of 0.5 mole percent and the operation continued. Subsequent metallurgical examination of later samples indicated a slight partial decarburization. According to the product specification, the results obtained utilizing atmospheres containing 0.5 and 0.75 mole percent methanol, balance nitrogen are entirely within the satisfactory range for surface carbon loss or gain for those grades of wire.

EXAMPLE 2

High carbon wire and rod (AISI types 1065, 1066, 1053, 1078, 1095, 4140, 1541, 1018, 1022) were spheroidized in the same furnace employed for the wire of Example 1. With the same furnace temperatures the residence time in the furnace was increased to 22 hours with the gas being supplied to Zones 2 through 7 consisting essentially of 1 mole percent methanol, balance nitrogen. Steady state operation was achieved as shown by the furnace gas analysis set out in Table II.

TABLE II

| FURNACE ATMOSPHERE ANALYSIS | | | | |
|---|---|---|---|---|
| | | | Dew Pt °F. | |
| Time | % CO | % CO2 | Zone 2 | Zone 7 |
| 9:00 a.m. | 0.8 | 0.04 | −35°(−37° C.) | −40°(−40° C.) |
| 3:00 p.m. | 1.0 | 0.04 | −30°(−34° C.) | −37°(−38° C.) |
| 9:00 a.m. | 0.85 | 0.03 | −31°(−35° C.) | −40°(−40° C.) |
| 4:35 p.m. | 0.75 | 0.035 | −29°(−33° C.) | −38°(−39° C.) |
| 11:00 a.m. | 0.85 | 0.045 | −30°(−34° C.) | −40°(−40° C.) |
| 1:20 p.m. | 0.95 | 0.05 | −30°(−34° C.) | −40°(−40° C.) |

The rod emerging from the furnace had a very light soot coating which was easily removed. Metallurgical examination of product samples showed no evidence of surface decarburization.

EXAMPLE 3

In order to demonstrate the capability of the methanol-nitrogen atmosphere to effect recarburization, a small laboratory batch furnace was utilized in a series of tests. AISI type 1080 rod was heated to a temperature of 1285° F. (696° C.) for 17 hours under an atmosphere derived from a composition consisting of essentially of 5 mole percent methanol balance nitrogen. Table III sets out the composition of the furnace atmosphere.

TABLE III

| | |
|---|---|
| % CO | 5 |
| % $H_2$ | 10 |
| % $CO_2$ | 0.36 |
| % $CH_4$ | 0.2 |
| Dew Point | +10° F.(−12.2° C.) |

Upon completion of the heat treating, examination of the steel rod showed a very light soot coating on the surface. Subsequent metallurgical examination showed no evidence of a change in the carbon content at the surface of the rod.

Subsequent to the first test a sample of AISI 1080 rod which had lost surface carbon during hot working was heated to 1400° F. (760° C.) for 17 hours in an atmosphere consisting essentially of 3 mole percent methanol, balance nitrogen. The furnace atmosphere had a composition as set out in Table IV.

TABLE IV

| | |
|---|---|
| % CO | 3 |
| % $H_2$ | 6 |
| % $CO_2$ | 0.08 |
| % $CH_4$ | 0.4 |
| Dew Point | −15° F.(−26° C.) |

Examination of the rod after treating showed a light soot coating. Subsequent metallurgical examination of the rod showed recarburization to a depth of 0.005 inches had occurred under this treatment.

EXAMPLE 4

AISI 1080 rod and AISI 1018 silicon killed wire were heated to a temperature of 1,285° F. (696° C.) for 17 hours in an atmosphere provided by injecting into the furnace a mixture consisting of 5 mole percent methanol by volume, balance nitrogen. The furnace had a nominal atmosphere consisting of:

5% carbon monoxide
10% hydrogen
0.3% carbon dioxide
0.2% methane
+10° F. (−12.2° C.) Dew Point The rod and wire removed from the furnace showed a very slight coating of soot. Metallurgical examination of samples of the rod and wire revealed no surface decarburization.

EXAMPLE 5

Samples of AISI 1080 rod and AISI 1018 silicon killed wire were heated to a temperature of 1400° F. (760° C.) for 17 hours in an atmosphere provided by injecting into the furnace a mixture consisting of 3 mole percent methanol, balance nitrogen. The furnace atmosphere had a nominal analysis of:

3% carbon monoxide
6% hydrogen
0.08% carbon dioxide
0.4% methane
−15° F. (−26° C.) Dew Point The rod and wire exiting the furnace had a very light soot coating. Metallurgical examination of samples of the rod and wire revealed a recarburization to a depth of 0.005 inches.

EXAMPLE 6

Samples of AISI 1040 steel having 0.004 inches surface decarburization were annealed at a temperature of 1,285° F. (696° C.) under atmospheres generated by injecting mixtures containing 3 mole percent methanol by volume, balance nitrogen and 6 mole percent methanol balance nitrogen into the furnace. The nominal furnace atmospheres were as follows:

| 3 Mole Percent Methanol Input | 6 Mole Percent Methanol Input |
|---|---|
| 2.8% CO | 4.75% CO |
| 0.5% methane | 1.2% methane |
| 0.48% $CO_2$ | 0.66% $CO_2$ |
| 5.4% $H_2$ | 7.1% $H_2$ |
| +30° F. (−1.1° C.) Dew Point | +39° F. (+3.9° C.) Dew Point |

Samples exiting the furnace at under both atmospheres showed light soot coatings. Metallurgical examination showed partial decarburization to 0.0041 inches, hardly measurable and well within annealing specifications.

Utilizing atmospheres according to the present invention as opposed to those of the prior art result in the following benefits:

1. Reduced natural gas consumption, and replacement of natural gas of variable and unknown composition with methanol of uniform purity.
2. Process flexibility and reliability.
3. Improved product quality.
4. Reduced flamability and toxicity of the atmosphere.
5. Adaptable to existing furnaces.
6. Safer.
7. Reduced Sooting.

In view of the fact that the atmosphere is produced by blending methanol and nitrogen outside the furnace, usually by means of a panel with flow controls it is possible to purge a furnace with substantially pure nitrogen in the event of furnace upset or other deleterious operating conditions to provide an inert blanket in the furnace.

Having thus described my invention, what is desired to be secured by Letters Patent of the United States is set forth in the appended claims:

1. In a method for spheroidizing a ferrous metal article by a combination of heating and cooling to produce a microstructure in the ferrous article exhibiting a rounded or globular form of carbide the improvement comprising heating and cooling said ferrous metal articles under an atmosphere prepared by forming a mixture of from 0.5 to 10 mole percent methanol, balance nitrogen and introducing said mixture into a furnace while said articles are heated and cooled to prevent removal of surface carbon from said ferrous articles.

2. A method according to claim 1 wherein said articles are heated to a maximum temperature below that at which the crystalline structure of said articles transform to austenite and held under atmosphere for a time sufficient to form globular carbides followed by slow cooling said articles to room temperature.

3. A method according to claim 1, wherein said articles are heated to a temperature above that transformation temperature necessary to austenitize the microstructure of said articles followed by cooling to and holding at a temperature below said transformation temperature followed by slow cooling to room temperature under atmosphere.

4. A method according to claim 1 wherein said articles are alternately heated and cooled to temperatures above and below its transformation temperature under atmosphere followed by slow cooling under atmosphere.

5. A method according to claim 1 wherein said mixture consists of from 0.5 to 6 mole percent methanol, balance nitrogen.

6. A method according to claim 1 wherein said mixture is adjusted to perform a carbon restoration treatment on the surface of the ferrous metal article being spheroidized.

7. A method of annealing a ferrous metal article in a multi-zone furnace comprising the steps of:

(a) charging the articles to be treated into the furnace wherein the first of said zones is maintained at a temperature above the austenite transformation temperature of the article being treated with succeeding zones being maintained alternately at temperatures below and above said transformation temperature;

(b) introducing into the furnace at ambient temperature a composition consisting essentially of from 0.1 to 10 mole percent methanol, balance gaseous nitrogen; wherein said methanol reacts, the reaction products and nitrogen forming a protective atmosphere that will inhibit decarburization of said article during thermal treatment;

(c) moving said article through the zones of said furnace in sequence beginning with said first zone in the presence of said furnace atmosphere where alternately in said zones of temperatures above the transformation temperature austenite is formed.

(d) cooling said articles to ambient temperature at a rate to provide an ambient temperature microstructure dictated by subsequent fabrication operations to be applied to said article.

8. A method of annealing a ferrous metal article in a furnace containing multiple heating zones, a cooling zone and an exit vestibule comprising the steps of:

(a) charging the articles to be treated into the furnace wherein the heating zones of said furnace are maintained at temperatures to promote formation of iron carbide in the microstructure of the articles being treated;

(b) introducing into said furnace at ambient temperature a composition consisting essentially of from 0.1 to 10 mole percent methanol, balance gaseous nitrogen; wherein said methanol reacts, the reaction products and nitrogen forming a protective atmosphere in the heating zones of said furnace to inhibit decarburization of said articles during thermal treatment;

(c) purging said cooling zone and said exit vestibule with substantially pure nitrogen;

(d) moving said article through said heating zones under the furnace atmosphere to promote formation of iron carbide in the microstructure of said articles;

(e) cooling said articles in said cooling zone to provide an ambient temperature microstructure dictated by subsequent fabrication operations to be applied to said articles; and (f) discharging said articles from said furnace through said exit vestibule.

* * * * *